US006212982B1

(12) United States Patent
Augustin et al.

(10) Patent No.: US 6,212,982 B1
(45) **Date of Patent: *Apr. 10, 2001**

(54) PROCESS FOR MANUFACTURING SLOT-SHAPED OPENINGS ON HOLLOW SECTIONS AND APPARATUS FOR IMPLEMENTING SAME

(75) Inventors: Helmut Augustin, Hamburg; Thomas Hülsberg, Rosengarten, both of (DE)

(73) Assignee: DaimlerChrysler AG, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/975,169

(22) Filed: Nov. 20, 1997

(30) Foreign Application Priority Data

Nov. 20, 1996 (DE) ..... 196 47 964

(51) Int. Cl.[7] ..... B21D 28/28

(52) U.S. Cl. ..... 83/18; 83/22; 83/30; 83/54; 83/178; 72/55

(58) Field of Search ..... 72/55–57, 370.27; 83/18, 22, 30, 54, 178

(56) References Cited

U.S. PATENT DOCUMENTS 5,816,089 * 10/1998 Maranfo ..... 72/55

FOREIGN PATENT DOCUMENTS

4334203A1 4/1994 (DE) .
4322063C1 8/1994 (DE) .
0588528A1 3/1994 (EP) .
0761336A1 3/1997 (EP) .

OTHER PUBLICATIONS

Search Report Feb. 2, 1998 Europe.

* cited by examiner

*Primary Examiner*—M. Rachuba
(74) *Attorney, Agent, or Firm*—Evenson, McKeown, Edwards & Lenahan, P.L.L.C.

(57) ABSTRACT

A process and apparatus for manufacturing slot-shaped openings on hollow sections is disclosed in which the openings are produced by a piercing cutting operation by means of a blade-type cutting tool by the displacement of material in a cutout-free manner. During the slotting operation, the hollow sections are supported from the inside around the openings to be formed. In order to produce slot-shaped openings in a simple manner while maintaining the shape of the hollow section on arbitrarily constructed hollow sections in a reliable process free of positional tolerances, the hollow section is inserted in a recess of an internal high pressure forming tool. The hollow section is slotted by the interaction of the cutting action of a cutting tool integrated in the internal high pressure forming tool and an internal high pressure generated inside the hollow section.

9 Claims, 3 Drawing Sheets

PROCESS FOR MANUFACTURING SLOT-SHAPED OPENINGS ON HOLLOW SECTIONS AND APPARATUS FOR IMPLEMENTING SAME

BACKGROUND AND SUMMARY OF THE INVENTION

This application claims the priority of German application 196 47 964.9–14 filed in Germany on Nov. 20, 1996, the disclosure of which is expressly incorporated by reference herein.

The invention relates to a process and apparatus for manufacturing slot-shaped openings on hollow sections with the openings being generated without cut outs by the displacement of material using a piercing cutting operation by means of a blade type cutting tool while supporting the hollow sections from the interior during slotting operation.

A process and apparatus of this type are known from German Patent Document DE 43 34 203 A1. There, passages are made in a linearly extending collecting pipe of a heat exchanger, in which case several punches, which are arranged in parallel to one another and are fastened on a carrier part and have blades constructed on their free ends, are jointly moved radially onto the hollow section to be worked which forms the collecting pipe. In this case, the punches tear the passages into the wall of the hollow section at the point of application. A rod-shaped tool with support sections is pushed into the hollow section, which support sections, in the appropriate position of the tool, are positioned between the application points of the hollow section for maintaining the shape of the hollow section. With the pushing-through of the hollow section by the punches, the hollow section material is displaced at that point, in which case the edge of the passage to be produced is bent while forming a wall neck projecting into the hollow section. The contact of the wall neck on the support sections ensures a rectangular course of the wall neck so that the hollow section has a defined seat for the flat tubes, which are fitted into the passages, for a later tight soldering. As a result of the bending of the penetration edges and their resting on the support sections of the rod-shaped tool, this tool is blocked with respect to an axial pulling out of the hollow section so that the tool cannot easily be removed from the hollow section to be worked. This is remedied by a bipartition of the tool, in which case first a lower half of the tool can be removed by a simple pushing-out; after which the upper half is rotated until it comes to rest below the bent edges. Then this half can also be pulled out.

In another embodiment, the tool, which now consists of one part, only partially fills the cross-section of the hollow section so that a clearance is formed which extends axially along the whole length of the hollow section. In this case, after the machining of the hollow section, the support tool is lowered and is pulled out of the hollow section.

In the case of both embodiments, the tool has a high-expenditure construction because of the support sections, in which case, they must have an extremely precisely adjusted distance from one another so that the hollow section can meet the precision requirements for the assembly with the flat tubes. At the same time, the handling of the tool requires high expenditures since it must be positioned in a precisely defined manner relative to the cutting tool. Because of the unavoidable positioning tolerances, the danger exists during the machining on the hollow section that one of the oblong punches will bend because it strikes a point of the hollow section wall which is supported by the support tool or is situated in the edge area of the respective support section, whereby the cutting tool may possibly be irreparably damaged. Likewise, the hollow section may also be damaged such that disadvantageous incisions occur on it which, particularly when the hollow section is used as a liquid-carrying component having sealing problems, will result in an increased reject rate of hollow sections. Furthermore, in the one case, the two-part support tool must be held together during the pushing-in and must be rotated when being removed after the machining, which results in lost production time. In the other case, for an effective support, a high holding force must be applied which is directed against the penetration force of the cutting tool, so that it is avoided that the one-part support tool is pressed into the clearance inside the hollow section under the effect of the cutting tool and, in the process, the support is impaired which is required for maintaining the shape of the hollow section.

The thickness of the bent edge at the points of the hollow section acted upon by the punches and the width of the respective support section of the rod-shaped support tool also determine the distance between the passages or openings. However, as a result, very small hollow sections may be too limited in their dimensions in order to be provided with several passages or openings by means of the described device.

In addition, the described manufacturing process and the device for its implementation can be used only in the case of linear hollow sections. Other shapes of hollow sections with cross-sectional changes and/or changes of course, such as bent pipes, cannot be provided with openings in this manner.

It is an object of the invention to further develop a process and apparatus of the above-mentioned type such that, in a simple manner and while maintaining the shape of the hollow section, slot-shaped openings can be manufactured in a reliable process on arbitrarily constructed hollow sections free of positional tolerances.

According to the invention, this object is achieved by a process and apparatus wherein, as a result of interaction between cutting action of the cutting tool integrated in an internal high pressure forming tool and an internal high pressure of a fluid generated within a hollow section disposed in a recess of the internal high pressure forming tool, the hollow section is slotted in a relative movement of the hollow section and of the cutting tool with respect to one another, with continuous, interior-side support of the hollow section by means of the pressure fluid, the support at the point of the piercing of the cutting tool into the hollow section being pushed back and the hollow section material, which is flowable under internal high pressure, flowing off laterally from respective piercing points around the piercing points while forming a wall thickening on the hollow section, and wherein the outer contour of the hollow section being pressed by means of internal high pressure against a contour of a face of a cutting tool carrier which is separate with respect to the cutting tool but is integrated with the cutting tool, which face forms a portion of the forming tool recess which faces the hollow section.

Because of the arrangement of the invention, a support tool can be eliminated because the support takes place by the internal high pressure applied inside the hollow section which loads the wall on all sides. In this case, only an internal-high-pressure forming tool is required into whose recess the hollow section is placed, in which case the die of the forming tool has a recess in which the cutting tool together with the support is accommodated. If the hollow section is also calibrated for exact dimensions which are uniform for all hollow sections to be machined, an internal-high-pressure forming tool is required anyhow so that in this case no additional tool—with the exception of the cutting tool—must be used. The recess may be constructed corresponding to the shape of the hollow section with respect to cross-sectional changes and to the axial course so that the device and the process are not subjected to any limitations in this respect. Furthermore, the construction of the slot-type openings takes place in a completely reliable manner with respect to the process because the cutting tool is never in any danger of impacting on a hard support object on which it may be damaged. Because of the recess of the forming tool which is adapted precisely to the hollow section and because of the non-existent requirement of positioning a support tool to be pushed into the hollow section, as well as the integration of the cutting tool into the forming tool in which the cutting tool takes up a defined relative position with respect to the forming tool, the hollow section, the cutting tool and the forming tool, which results in the support within the hollow section, are always positioned precisely with respect to one another in the machining position, in which case no manufacturing tolerances can occur. By means of the simultaneous support of the outer circumference of the hollow section on the recess, no deformations of the original shape of the hollow section will occur so that, as the result, the dimensional accuracy of the hollow section as a whole is maintained. The forming of the hollow section and the providing of the openings on it take place in the same tool and therefore in one operating cycle without the requirement of opening the tool and setting it up again for the cutting operation.

Furthermore, by means of the invention, very small-construction hollow sections can also be provided with a large number of openings because a support section of a discussed tool of a finite width and the thickness of the hollow section wall which determines the width of the immersion gap for the blade of the cutting tool, are eliminated. The minimum distance between the openings is therefore determined only by the blade width of the cutting tool, advantageously, also in the case of larger-construction hollow sections, several openings being formable on a partial section. Virtually because of the existing internal pressure, the hollow section material displaced by the blade flows laterally away from the blade and is pressed against the hollow section wall surrounding the respective opening, which, in the case of the finished hollow section, is exhibited in a wall thickening. Because of the displacement of material, the cutting of the hollow section takes place without any occurrence of cuttings and without waste.

Finally, openings can be achieved which have sharp-edged margins and thus no bending radii on the exterior side of the section. This maximizes the support surface for add-on pieces to be mounted later so that, during the mounting, the Hertzian stress is distributed as well as possible.

Other objects, advantages and novel features of the present invention will become apparent from the following detailed description of the invention when considered in conjunction with the accompanying drawings.

DETAILED DESCRIPTION OF DRAWINGS

Figure 1:
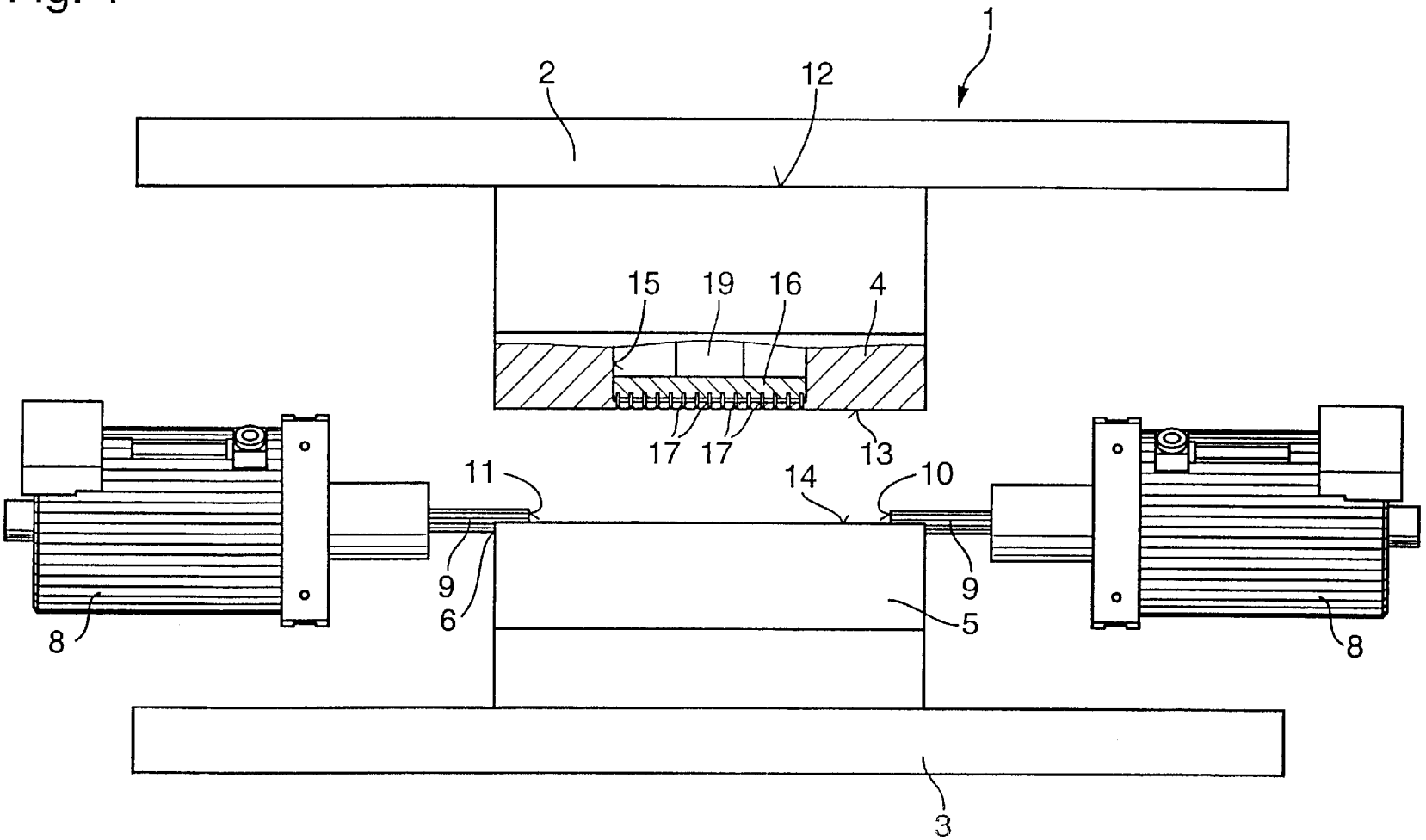
FIG. 1 is a schematic lateral view of an apparatus constructed according to a preferred embodiment of the invention showing a partial longitudinal sectional view of the top tool of the forming tool assembly.

FIG. 1 illustrates an internal-high-pressure forming tool 1 which contains a press slide 2 and a bedplate 3, the press slide 2 being guided to be liftable and lowerable in strokes and being connected with a hydraulic cylinder, by means of which the press slide 2 in the closed condition of the forming tool 1 can be held on the bedplate 3 against the generated internal high pressure. A top tool 4 is fastened on the bottom side on the press slide, while a bottom tool 5 is mounted opposite on the bedplate 3 on the top side, the faces 13, 14 of the bottom tool 5 facing one another having molded-out portions which form a recess 6 in which a hollow section 7 can be placed and which essentially matches it in its molding-out and its cross-sectional measurements. One high pressure cylinder 8 respectively is arranged laterally of the forming tool 1 on both sides, by means of which high pressure cylinder 8 a follow-up punch 9 can be displaced axially with respect to the hollow section 7. By way of a high pressure duct extending in the follow-up punch 9, a high-pressure fluid for the high-pressure forming is introduced into the hollow section 7 and the internal high pressure is generated by means of the fluid. Furthermore, the follow-up punch 9 is used, on the one hand, for the axial sealing of the hollow section 7 by way of its faces 10, 11 facing the ends of the hollow section 7 and, on the other hand, for the axial follow-up guiding of profile material in the case of a radial widening of the hollow section 7 by means of the internal high pressure for known purposes.

Figure 2:
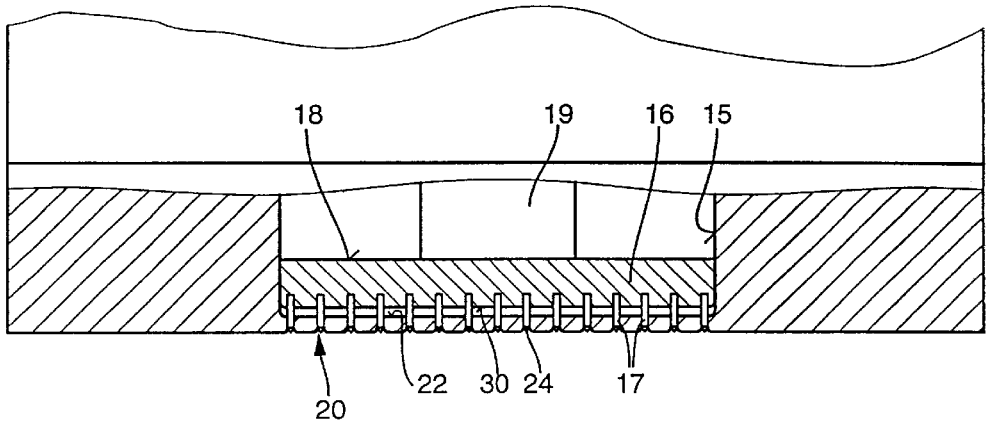
FIG. 2 is an enlarged lateral view of the top tool of FIG. 1.

Starting from the face 12 of the top tool 4 facing away from the recess 6, a recess 15 is worked into the top tool 4 and ends close to the other face 13 of the top tool 4. In the recess 15 a strip-shaped carrier 16 is received on which several blade-type cutting tools 17 are held which are arranged in parallel to one another, as also illustrated particularly in FIG. 2. The cutting tools 17 are constructed as sharpened slides which, in the sharpened area, have sharp edges which form the blades 25. Within the recess 15, the carrier 16 can be displaceably guided radially toward the recess 6 by means of a high-pressure cylinder 19 which is connected with it on the side 18 which is rearward with respect to the recess 6. In the internal-high-pressure forming process, the high pressure cylinder 19 is used in the same manner as the counterholder for the carrier 16 and for the cutting tools 17.

In this case, the cutting tools 17 are fixedly connected with the carrier 16 and dip into guide gaps 20 which extend inside the forming tool 4 radially toward the recess 6 and connect its face 13 with the recess 15. The cutting tools 17 may be displaceable inside the gaps 20 in a precisely fitting manner for an optimal sealing of the recess 15 in the direction of the recess 6 or with play with a lubrication for reducing the friction on the gap wall 21. In the case of an accurate fit, it is conceivable to coat the gap wall 21 with a solid lubrication for reducing the friction, for example, with graphite or molybdenum sulfide. As an alternative, a coating is also contemplated as a wear protection layer consisting of metal nitrides, carbides or carbon nitrides, such as TiN, TiC, TiCN.

As an alternative to the fastening of the cutting tools 17 on the carrier 16, it is contemplated to arrange the carrier 16 stationarily in the recess 15 close to the face 13 of the top tool and to displaceably guide the cutting tools 17 in the carrier 16. For driving the cutting tools 17, a transverse duct would then be provided in the carrier 16 which leads to the outside and can be acted upon by a high-pressure fluid and which cuts a blind-hole-type guide bore of the cutting tools 17 on their base and, when acted upon by high pressure, drives the cutting tools 17 toward the recess 6. The driving of the cutting tools 17 back into their inoperative position can take place by the internal high pressure within the cut-in hollow section 7 while simultaneously removing the pressure inside the transverse duct. In order to hold the cutting tools 17 in this case in the carrier 16 so that they cannot be lost, a stop must be provided on them which finds a counterstop inside the carrier 16 or on the base 22 of the recess 15.

Instead of the construction of a transverse duct, a blind-hole-type bore which points radially to the recess 6 may be constructed in the carrier 16, in which bore the respective cutting tool 17 is guided. For this purpose, the cutting tool 17 is constructed as a punch whose punch shaft has a tip equipped with the blades 25. On its face away from the recess 6, the plate-shaped head of the punch can be acted upon by a high-pressure fluid and, on the opposite face, is in an operative connection with a screw-shaped pressure spring which is supported on the base of the blind-hole bore and drives the punch into the inoperative position of the cutting tool 17. In this case, the bore is divided into two partial spaces by the punch head. Depending on which acting force (pressure force of the fluid—spring force) is predominant, the punch is pushed back and forth between the operative position and the inoperative position. By means of the arrangement of a ring seal on its circumference in preferred embodiments, the punch seals off the fluid-carrying partial space of the bore from the partial space in which the spring is arranged.

Figure 3A:
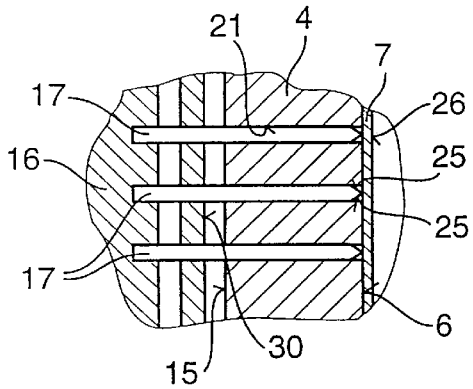
FIG. 3*a* is a horizontal sectional top view of a section of the top tool having cutting tools in the uncut condition of the hollow section inserted in the recess of the forming tool.
Figure 3B:
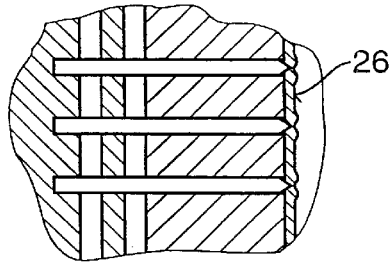
FIG. 3*b* is a view of the section from FIG. 2*a* showing the cutting tools cutting into the hollow section.
Figure 3C:
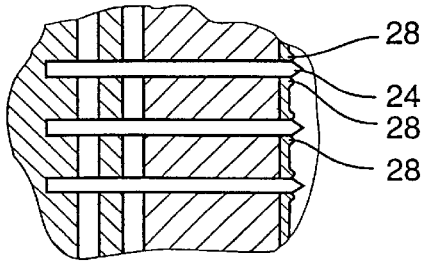
FIG. 3*c* is a view of the section from FIG. 3*a* after the penetration of the hollow section by the cutting tools.
Figure 5A:
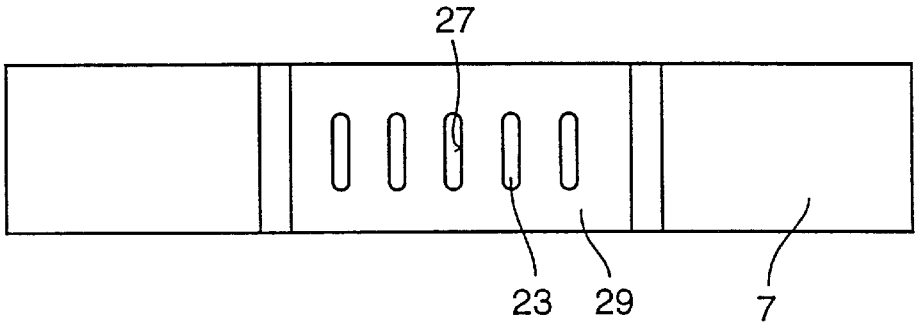
FIG. 5*a* is a top view of the machined hollow section from FIG. 3*a;*
Figure 5B:
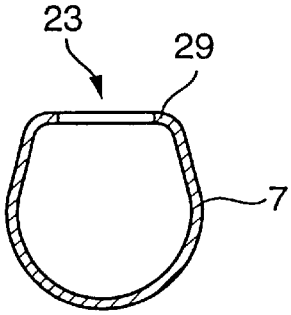
FIG. 5*b* is a cross-sectional view of the hollow section from FIG. 5*a.*

As illustrated in FIGS. 5*a, b*, for manufacturing slot-shaped openings 23, the hollow section 7 is placed in the recess 6, after which the forming tool 1 is closed by lowering the top tool 4 onto the bottom tool 5. After a high-pressure fluid is introduced into the hollow section 7, a high pressure is generated in the range of between 800 and 3,000 bar, the hollow section 7 radially widening and placing itself completely onto the recess 6 and as a result being calibrated. During this operation, the cutting tools 17 are in the inoperative position, in which case the slide tip 24 ends flush with the side 13 of the top tool 4 (FIG. 3*a*). After the calibration, while there is still internal high pressure, the carrier 16 is displaced by the high-pressure cylinder 19 in the recess 15 toward the hollow section, in which case the blades 25 of the cutting tools 17 penetrate into the hollow section material in the normal line direction with respect to the impact point on the hollow section 7. As the result of the internal high pressure directed against the movement of the cutting tools 17, the hollow section material displaced by them during the penetration is pressed laterally away from the blades 25 onto the interior wall 26 of the hollow section 7 (FIG. 3*b*). During the cutting penetration of the hollow section 7 by the blades 25, the slot-shaped openings 23 are finally formed. As the blades 25 come through, the penetration operation of the cutting tools 17 is concluded and the displacement movement of the carrier 16 toward the hollow section 7 is finished. Because of the internal high pressure which makes the hollow section material flowable, a toroidal wall thickening 28 on the hollow section 7 (FIG. 3*c*) is formed around the edge 27 of the openings 23.

By means of the permanent contact pressure onto the face 13 of the top tool 4 during the cutting action of the cutting tools 17 in the pushing movement, the exterior wall of the hollow section 7 remains untouched by a possible deformation induced by the penetration so that the dimensional accuracy of the exterior wall is ensured during the machining operation. After the slotting, the internal high pressure is reduced and the cutting tools 17 are withdrawn into the guiding gaps 20 of the top tool 4 by way of a withdrawal movement of the carrier 16 operated by the high pressure cylinder.

It is also contemplated according to other preferred embodiments of the invention to provide a passage in the top tool instead of the recess 15, in which passage the carrier 16 can be displaceably guided, in which case its face 30 pointing to the hollow section 7 forms a portion of the recess 6. In this case, during the calibration, the face 30 can adjoin the face 13 of the top tool 4 in an aligned manner or it can be in an end position withdrawn into the top tool 4 so that, by means of the face 30 of the carrier 16 and the surrounding walls of the top tool 4, an expansion trough is formed which is part of the recess 6 and whose base is formed by the face 30.

For this arrangement, the cutting tools 17 together with their carrier 16 can be stationarily connected with the top tool 4 designed as a die, the cutting tools projecting into the expansion trough. For manufacturing the openings 23, the hollow section 7 is expanded by the effect of the internal high pressure and is pressed onto the oppositely projecting cutting tool 17 protruding into the expansion trough, in which case, after the yield limit of the hollow section material is exceeded, the slot-shaped openings 23 are formed.

It is also contemplated to arrange the cutting tools 17 such that they project stationarily and thus non-displaceably into a recess 6 which has no expansion trough. However, in this case, the hollow section 7 to be formed and widened must be dimensioned such that, when it is placed in the recess 6, it is spaced away from the cutting tools.

In both the last two described cases, the slotting and the calibrating or forming of the hollow section 7, in the interest of an economical process, takes place simultaneously, in which case no movable tool parts are required for the cutting of the openings 23. This is achieved solely by the internal high pressure. For removing the slotted hollow section 7, when the forming tool 1 is opened, this forming tool may have to be held so that the cutting tools 17 can be pulled out of the hollow section 7 by way of the stroke of the top tool 4. In the case of large and heavy hollow sections 7, the holding measure may be eliminated because of the force of gravity replacing the holding force.

The providing of the slot-shaped openings 23 may also take place in that the hollow section 7 is notched at the point of the opening 23 to be formed by a cutting tool 17 guided onto the hollow section 7. The generating of the opening 23 will then take place by the effect of the internal high pressure onto the notch point. In this case, the cutting tools 17 may again be arranged in the withdrawn inoperative condition so that, merely as the result of the weak point produced by the notching, the internal high pressure will divide it in a material-displacing manner while forming a penetration.

It is also contemplated that the blades 25 of the cutting tools 17 remain in the notching position, in which case the internal high pressure, at the notching point along the blades 25, laterally pushes away the hollow section material it made flowable so that one opening 23 respectively is formed. As the result of the manufacturing process of openings 23 by means of notching in conjunction with internal high pressure, only the essential part of the cutting tool, specifically the blade 25, comes in physical contact with the hollow section 7 so that, when the cutting tool 17 is withdrawn after the machining operation, the possible danger of a jamming in the hollow section 7 does not occur.

The hollow section 7 can be constructed according to the half-shell construction method in two parts or in one part, for example, as an extruded section, the one-part construction resulting in cost and quality advantages during the manufacturing. The hollow section 7 may be formed from an unprofiled blank placed in the internal-high-pressure forming tool, the profiling taking place by internal high pressure before the providing of the openings 23 in the forming tool 1. Between the profiling and the providing of the openings 23, the calibration of the hollow section 7 takes place which occurs at a particularly high internal pressure and which, because of the contact pressure on the profile 7, provides the desired dimensionally accurate, exterior shape of the hollow section 7 which has no manufacturing tolerances. In this case, the two machining steps take place in one operating cycle without opening the tool in-between.

Figure 4A:
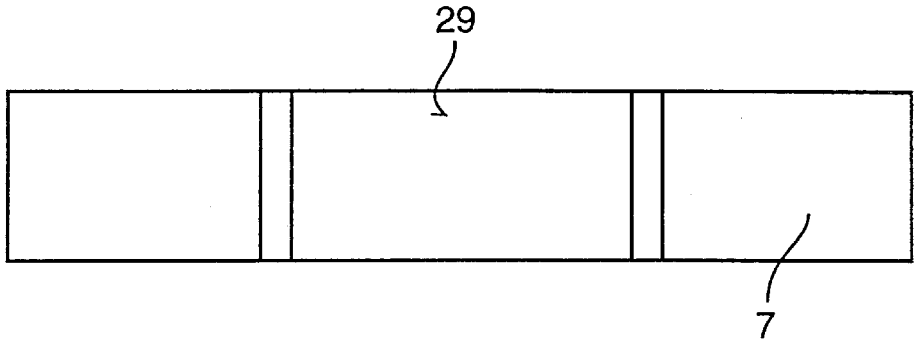
FIG. 4*a* is a top view of the unmachined hollow section from FIG. 3*a;*
Figure 4B:
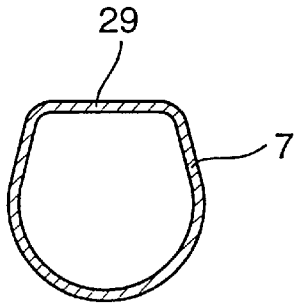
FIG. 4*b* is a cross-sectional view of the hollow section from FIG. 4*a;*

Slot-shaped openings 23 on a hollow section 7 are required, for example, when the hollow section 7 is used as a radiator tank of a vehicle radiator in order to insert into them flat tubes which extend transversely to the radiator tank and then establish a connection of the flat tubes, which is water-tight toward the outside, with the radiator tank at the insertion point, for example, by soldering. FIGS. 4*a* and *b* show this radiator tank in the still unslotted condition. The radiator tank has a pipe-shaped construction and, on a circumferential section, has a plane, flat surface 29 which extends axially continuously through the radiator tank.

As illustrated in FIGS. 5*a* and *b*, the openings 23 are cut into this flat area 29. Particularly the flat area 29 must be dimensionally accurate since otherwise, because of the resulting different distance between the two opposite radiator tanks of a vehicle radiator, the flat tubes could not be assembled with the radiator tanks to form the radiator. This dimensional accuracy, as the result of the contact pressure of the hollow section 7 onto the correspondingly shaped recess 6, is first optimized by the calibration and is then maintained during the cutting operation. Advantageously, the high-pressure fluid is introduced by way of the connection to the lines of the cooling circulation system already existing at the radiator tank, and the high pressure is generated. This eliminates the construction of a separate connection which will no longer be required in the use of the finished radiator tank. In this case, the diameter of the connection opening is smaller than the width of the radiator tank. For the later fitting-on of a cooling water hose, a hose taper plug may also be molded out by means of internal high pressure forming on the circumference of the connection opening.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A method for manufacturing a slot-shaped opening on a hollow section of a workpiece utilizing a blade-type cutting tool, comprising the steps of:

continuously supporting an interior side of the hollow section by an internal high pressure fluid supplied into the hollow section;

pressing or calibrating an exterior side of the hollow section against a contoured face of a carrier for the cutting tool by way of the internal high pressure fluid supplied in the hollow section, the face of the cutting tool carrier forming a portion of a recess for supporting the hollow section;

piercing the hollow section by moving the cutting tool relative to the hollow section, wherein the piercing step includes one of:

(i) penetrating the cutting tool into a material of the hollow section and then stopping the penetration, and (ii) penetrating the cutting tool into a material of the hollow section and continuing through an interior wall of the hollow section; and displaceably flowing a portion of the material of the hollow section which is pierced by the cutting tool laterally away from the cutting tool and into the hollow section to form the slot-shaped opening having a wall thickness around the slot-shaped opening, the material of the hollow section being flowable due to the internal high pressure fluid supplied into the hollow section.

2. The method for manufacturing a slot-shaped opening of claim 1, wherein the internal high pressure fluid is supplied in the range of between 800 and 3,000 bar.

3. The method for manufacturing a slot-shaped opening of claim 1, wherein the step of piercing the hollow section by penetrating the cutting tool into the material of the hollow section and stopping the penetration includes forming a notch at a point where the slot-shaped opening is to be formed and keeping the cutting tool in a notching position, and the step of displaceably flowing a portion of the material of the hollow section occurs due to the internal high pressure fluid acting on the notch.

4. The method for manufacturing a slot-shaped opening of claim 1, wherein the step of piercing the hollow section by penetrating the cutting tool into the material of the hollow section and stopping the penetration includes forming a notch at a point where the slot-shaped opening is to be formed and then withdrawing the cutting tool from the notch into an inoperative position, and the step of displaceably flowing a portion of the material of the hollow section occurs due to the internal high pressure fluid acting on the notch.

5. The method for manufacturing a slot-shaped opening of claim 1, wherein the step of pressing or calibrating and the step of displaceably flowing a portion of the material of the hollow section to form a slot-shaped opening are performed simultaneously.

6. The method for manufacturing a slot-shaped opening of claim 1, wherein the cutting tool is integrated in a movable internal high pressure forming tool and the hollow section is formed by a step in which a hollow blank is placed in the internal high pressure forming tool and profiled by internal pressure before the step of displaceably flowing a portion of a material of the hollow section to form a slot-shaped opening.

7. The method for manufacturing a slot-shaped opening of claim 1, wherein the hollow section is moved relative to the cutting tool during the step of piercing the hollow section by expanding the hollow section by the internal high pressure fluid and the slot-shaped opening is formed after exceeding a yield limit of the material of the hollow section.

8. The method for manufacturing a slot-shaped opening of claim 1, wherein the step of piercing the hollow section consists of penetrating the cutting tool into a material of the hollow section and then stopping the penetration.

9. The method for manufacturing a slot-shaped opening of claim 1, wherein the step of piercing the hollow section comprises penetrating the cutting tool into a material of the hollow section and continuing through an interior wall of the hollow section.

* * * * *